US007755562B2

(12) United States Patent
Runte

(10) Patent No.: US 7,755,562 B2
(45) Date of Patent: Jul. 13, 2010

(54) RF TRANSPARENT BARRIER

(76) Inventor: Matthew Runte, 73 Terra Bella Dr., Walnut Creek, CA (US) 94596

( * ) Notice: Subject to any disclaimer, the term of this patent is extended or adjusted under 35 U.S.C. 154(b) by 906 days.

(21) Appl. No.: 11/549,109

(22) Filed: Oct. 12, 2006

(65) Prior Publication Data

US 2007/0247381 A1 Oct. 25, 2007

Related U.S. Application Data

(60) Provisional application No. 60/793,906, filed on Apr. 21, 2006.

(51) Int. Cl.
*H01Q 9/34* (2006.01)
*H01Q 1/12* (2006.01)

(52) U.S. Cl. ..... 343/874; 343/890

(58) Field of Classification Search ..... 343/874, 343/878, 890
See application file for complete search history.

(56) References Cited

U.S. PATENT DOCUMENTS 4,649,675 A * 3/1987 Moldovan et al. ..... 52/27
4,922,264 A * 5/1990 Fitzgerald et al. ..... 343/878
5,963,178 A 10/1999 Jones
5,979,844 A * 11/1999 Hopkins ..... 248/158
6,697,689 B2 2/2004 Lendriet
6,798,387 B2 * 9/2004 Cockell et al. ..... 343/878
7,098,864 B2 * 8/2006 Ryan ..... 343/890
2003/0117337 A1 6/2003 Lendriet

* cited by examiner

*Primary Examiner*—Shih-Chao Chen
(74) *Attorney, Agent, or Firm*—Kane Kessler, P.C.; James E. Hanft

(57) ABSTRACT

A pre-engineered, packaged RF transparent barrier for non-penetrating installation on a roof, ground, or other surface can be pre-fabricated in different heights and or widths such that customizable barriers can be implemented without manufacturing costs typical of designing custom antenna gate structures. RF transparent materials reduce potential barrier-caused problems such as interference or reflection of RF signals. The barrier balances RF degradation potential, structural integrity, and cost considerations in its design, fabrication, and installation. A method of fulfilling the requirements for an antenna barrier installation is described.

11 Claims, 4 Drawing Sheets

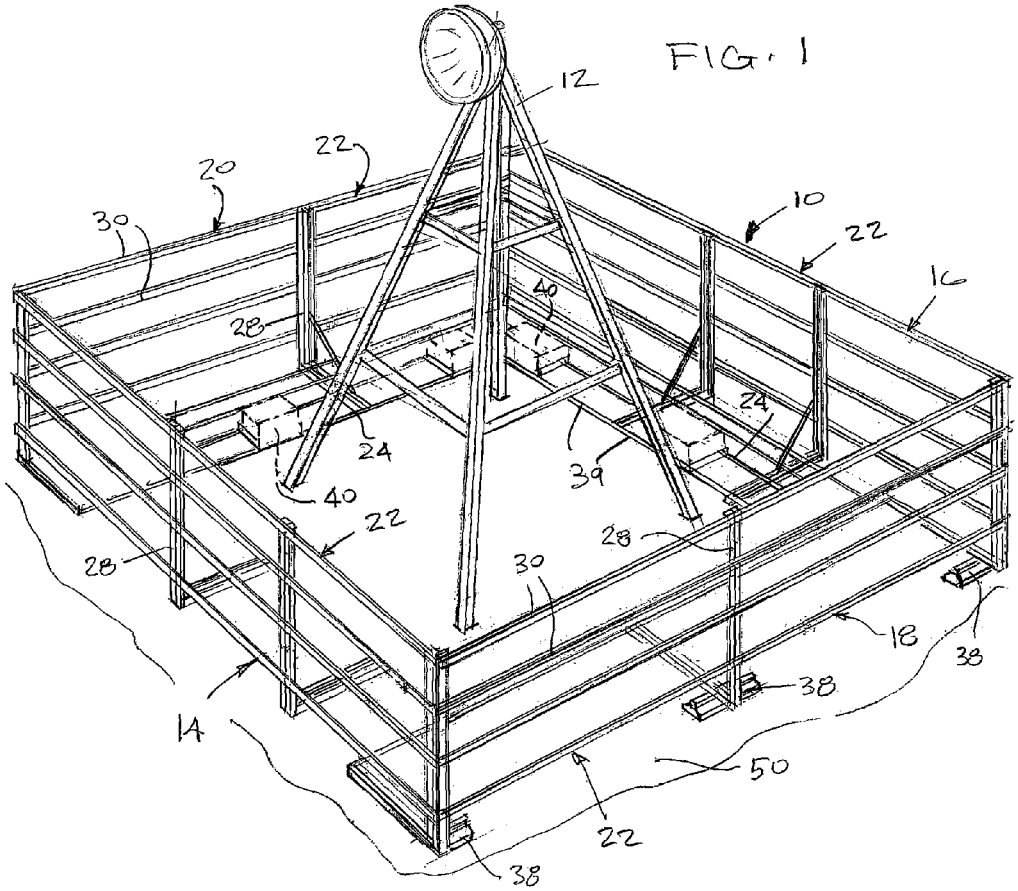
FIG 6
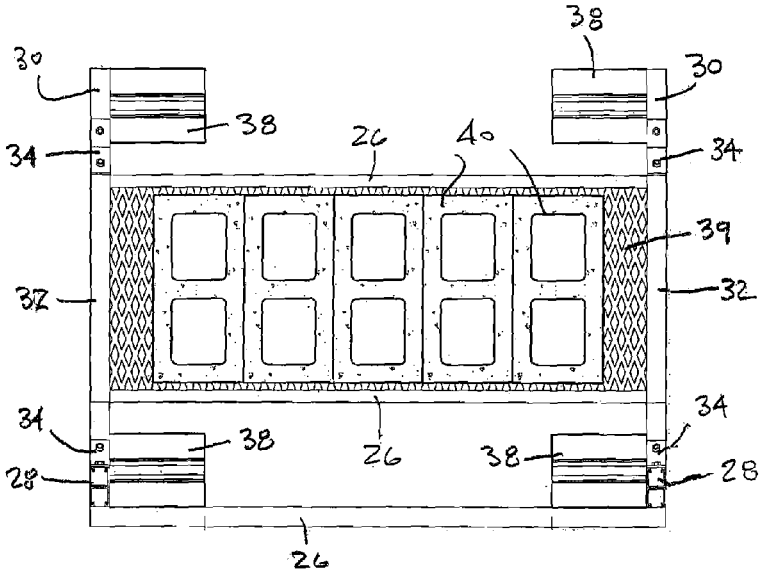

FIG. 4
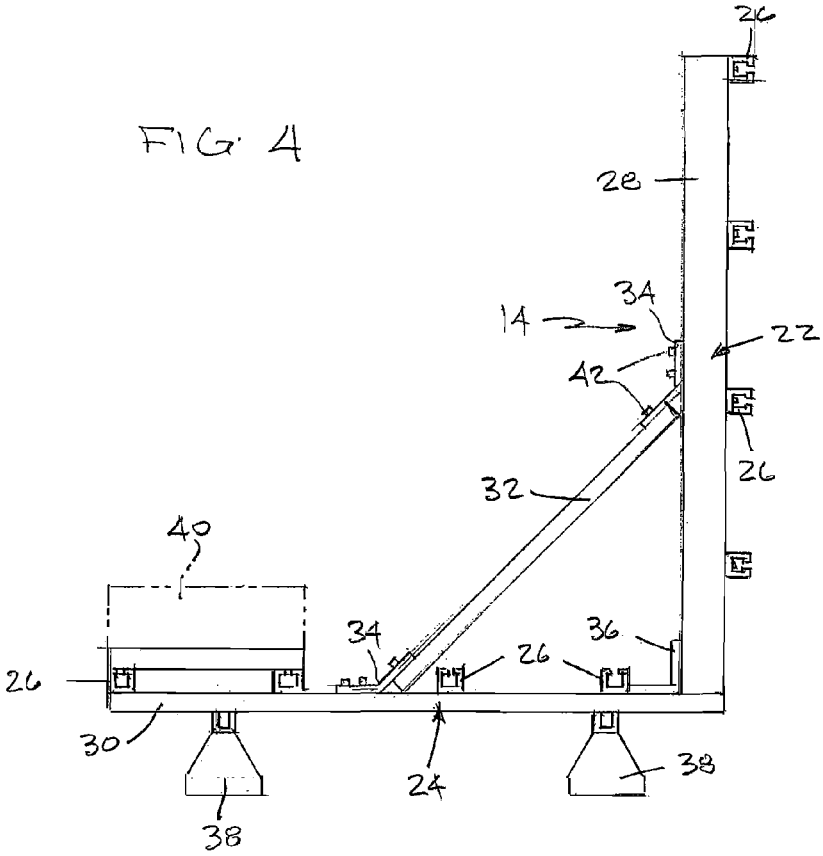
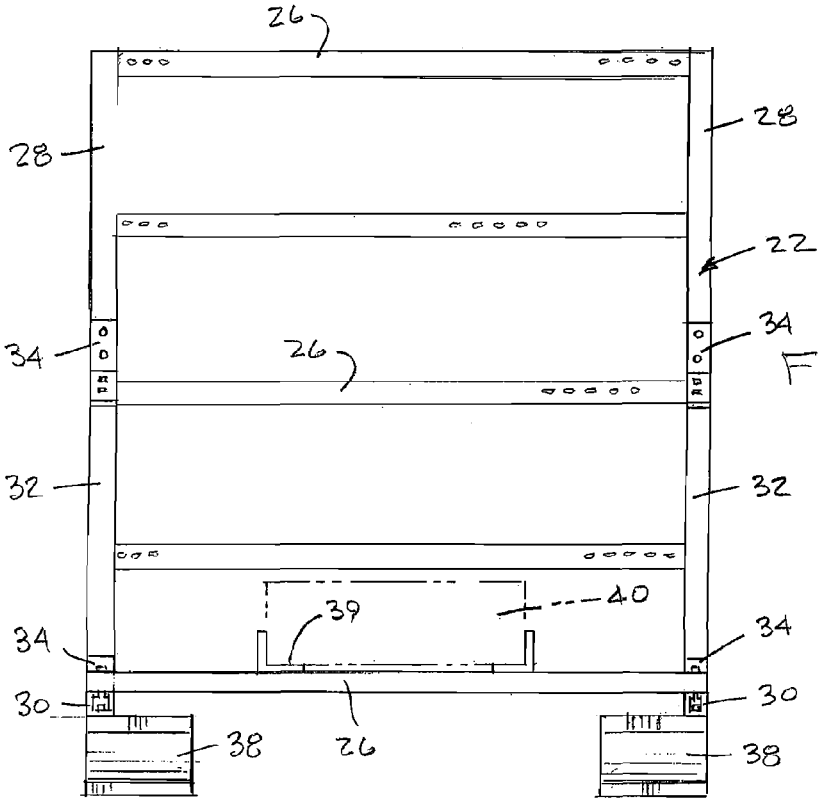
FIG 5

RF TRANSPARENT BARRIER

This application claims the priority benefit of U.S. Provisional Application Ser. No. 60/793,906; filed Apr. 21, 2006.

FIELD OF THE INVENTION

The present invention relates to gates for radio frequency (RF) antenna systems. More specifically, the present invention relates to structures and methods for pre-engineered RF-permeable barriers for guarding or gating RF antenna systems.

BACKGROUND OF THE INVENTION

Cellular communications networks utilize radio frequency (RF) antenna systems at "cell sites" to transmit and receive RF signals. Cell sites are typically spaced from three to eight miles apart to achieve acceptable results. Consequently, a large metropolitan area can include hundreds of individual cell sites to insure thorough coverage. RF antenna systems are typically strategically placed atop the most prominent, visible locations within the surrounding landscape, attached to the sides or rooftops of buildings, or are mounted on new or existing tower structures. Furthermore, many such antenna systems are installed at locations which are accessible to maintenance personnel or the general public.

To distract would-be vandals, reduce access to areas of potentially high RF emissions, and reduce tampering of RF antenna systems, barriers are typically constructed to surround an antenna preventing access to the antenna and surrounding area. Also, concealment strategies have been attempted to make antennas blend within the existing architecture of a building or a location.

Successfully gating existing RF antenna systems requires a number of constraints to be considered including the design, fabrication and mounting of the antenna gate structure. These constraints include, for example, the structural integrity of the gate within any requirements of the local and/or regional building codes, the avoidance of RF signed degradation, the ability to resist degradation from environmental effects, and the capability for relatively quick installation with minimal damage to the surrounding environment, e.g., land or rooftop. Ideally, all of these constraints should be satisfied, or balanced, while maintaining economic viability.

Many communities, including most major cities, either already have, or will have, codes that demand concealment and/or securement of a cell site. Since each potential cell site is unique, no single antenna barrier structure or design will suffice. There is a need for an alternative to having a custom engineered barrier assembly for each site. Specifically, there is a need for an RF antenna barrier kit which can be efficiently assembled by the end user and which includes all materials required for assembly. What is further needed is such a kit that does not require design engineers and architects to custom build the gate structure as a function of the size and location of any given installation. The present invention addresses these and other needs.

SUMMARY OF THE INVENTION

The present invention provides a structure for pre-engineered RF permeable barriers for surrounding, guarding or gating RF antenna systems.

The present invention provides a pre-engineered, pre packaged RF transparent barrier. The barrier is non-penetrating in its installation (i.e. no roof, ground, or surface penetrations are required in its installation or assembly), pre-fabricated in different heights, widths, or both, such that customizable barriers can be implemented without the manufacturing costs attendant with designing custom antenna gate structures. By replacing the need for custom parts and installation with prefabricated structures, the overall cost of the barrier is reduced. The use of RF transparent materials in part, or all, of the barrier reduces potential barrier-caused problems such as interference or reflection of RF signals.

A barrier in accordance with the invention balances RF degradation potential, structural integrity, and cost considerations in its design, fabrication, and installation.

In one aspect, a barrier for surrounding an RF antenna and for placement on a surface at the cell cite is disclosed. The barrier includes a side wall having horizontal and vertical supports and a base integral to a bottom edge of the side wall. The base has horizontal supports and cross-bars and at least one pair of legs depending therefrom which allow the barrier to stand upright relative to the surface without penetration. The horizontal supports define a ballast support useful in securing the side walls to a surface free of any surface penetration by instead relying on the weight of a ballast. The horizontal supports, vertical supports and cross-bars are RF transparent.

In accordance with another aspect of the invention, a method for fulfilling requirements of an antenna barrier installation of a given size at an antenna location comprises the steps of receiving installation parameters concerning the antenna barrier installation at the antenna location, the installation parameters including the given size of the installation, calculating components necessary to fulfill the antenna barrier installation requirements in view of the received parameters, defining a pick list of component parts based on the calculated components which together can be assembled into a completed antenna barrier at the antenna location, and shipping the component parts in the pick list in fulfillment of the antenna barrier installation requirements.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 1 shows a perspective view of an antenna barrier structure surrounding a cell site radio frequency antenna;

FIG. 4 shows a front plain view of the antenna barrier structure of FIG. 2;

FIG. 5 shows a side plain view of the antenna barrier structure of FIG. 2; and FIG. 6 is a flow diagram for fulfilling the requirements of an antenna barrier installation for an antenna site.

DETAILED DESCRIPTION OF THE PREFERRED EMBODIMENT

Figure 2:
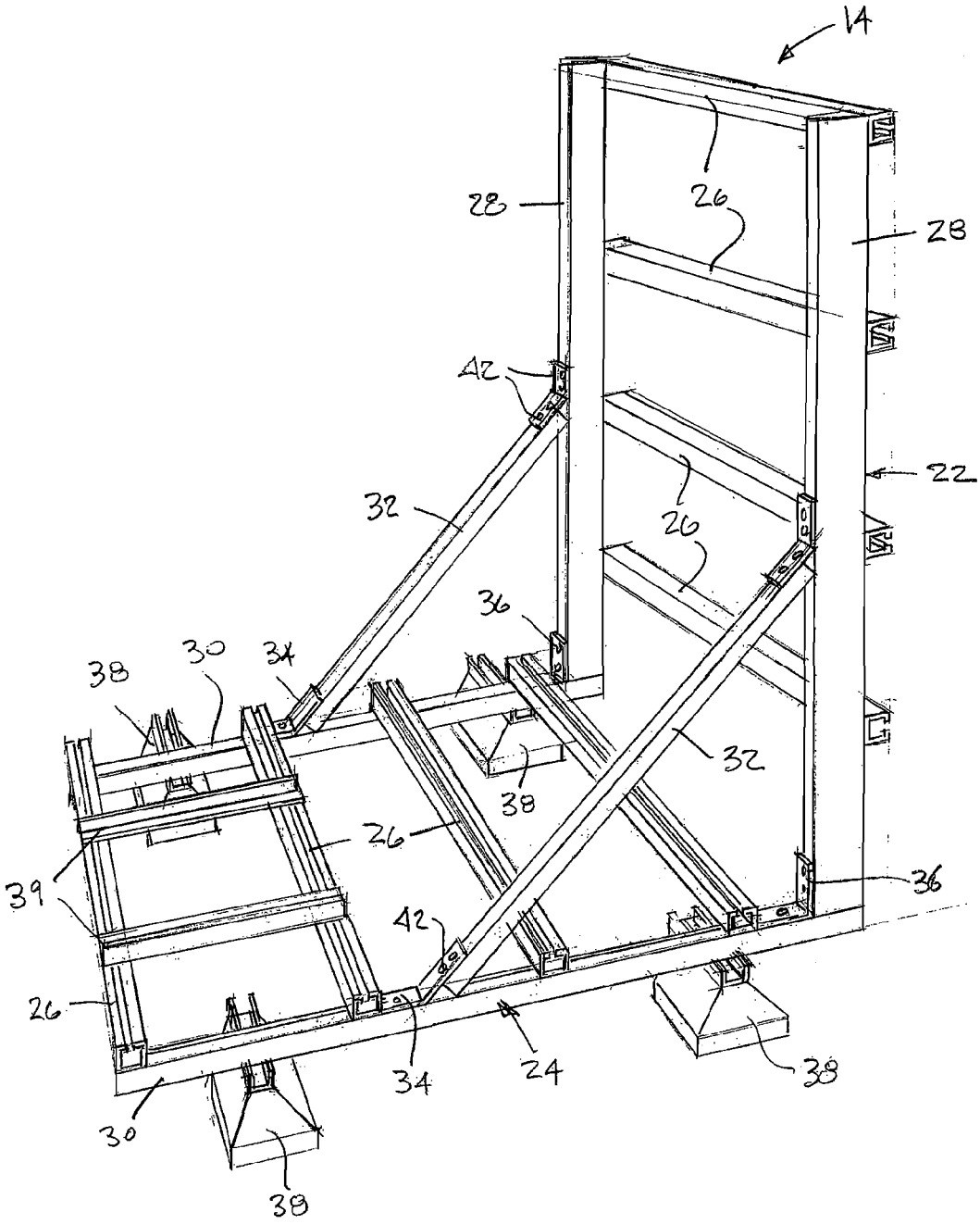
FIG. 2 shows a perspective view of an antenna barrier structure for placement about a cell site radio frequency antenna.

The following description is provided in the context of a particular application of the invention and its requirements. Various modifications to the disclosed embodiments will be readily apparent to those skilled in the art and the features described herein may be applied to other embodiments and applications without departing from the spirit and scope of the present invention. Thus, the present invention is not intended to be limited to the embodiments shown.

The present invention pertains to RF antenna barriers composed in-part, or entirely, of RF transparent materials, and more preferably Fiberglass Reinforced Plastic (FRP), though other RF transparent materials and plastics such as polyfoam, glass or plexiglass can be used. These materials can be and are preferably assembled at the location of the antenna. A complete RF antenna barrier kit in accordance with a preferred embodiment comprises all materials required for assembly such that on-site barrier construction can be done efficiently. Depending on specific customer requirements, a complete RF antenna kit can be packaged and shipped with or without the ballasts or epoxy described below.

The barriers, constructed of FRP channels, sections, connectors and bolts are available in various widths and heights to satisfy a variety of RF antenna structures and mounting environments. Structural properties of the selected material include, but are not limited to, tensile strength and dielectric constant which are to be considered in determining the material's suitability for use in the barrier, as described further below.

FIG. 1 shows a configuration of an embodiment of an antenna barrier structure 10 that can be used to gate a cell site RF antenna 12. Barrier structure 10 is used to deter and prevent access to one or more cell site RF antennas 12 by partially or wholly surrounding the cell site from all accessible directions except from air space above the barrier.

The antenna barrier structure 10 comprises four individual barrier sections 14, 16, 18 and 20, respectively, and can have a box-shaped configuration with a top opening. Each individual barrier section is represented without its specific constituent parts, such as cross-bars and vertical and horizontal supports, for ease of illustration. Antenna barrier structure 10 is configured for placement on the roof of building, wooded area, open field, black-top, or any other man-made or naturally occurring structure where a cell site can be installed and operated. Fasteners for securing barrier structure 10 to surface 50 are unnecessary because legs 38 and a ballast support 39 are provided which are utilized to seat the barrier, as described below.

Antenna barrier structure 10 is formed by coupling multiple barrier structures together, along adjacent vertical supports 28 and cross-bars 30 (FIG. 2). Thus, antenna barrier structure 10 can include four RF transparent side walls 22 and bases 24 which join at respective corners 23 as shown in FIG. 1 as well as many or all of the features described in connection with FIGS. 2-5 below.

Referring to FIG. 2, an individual barrier section 14 is shown in detail and it is to be understood that barrier sections 16, 18 and 20 can be designed the same way. Antenna barrier section 14 includes a side wall 22 and a base 24 affixed to side wall 22. More particularly, side wall 22 includes horizontal supports 26, each horizontal support 26 being fixed at its ends between vertical supports 28.

Base 24 includes horizontal supports 26, each being fixed at its ends between cross-bars 30. Antenna barrier section 14 further includes braces 32. Each brace 32 is fixed at its ends at midpoints along a respective vertical support 28 and horizontal cross-bar 30 using a hinge 34. As shown, side wall 22 and base 24 connect at their union utilizing hinges 36. Support brace 32 provides an additional connection of the side wall and base to rigidify the antenna barrier section 14.

Horizontal supports 26 and braces 32 are preferably continuous FRP members integral to barrier 14 to provide dimensional stability to the barrier and to serve as strengthening elements. Horizontal and vertical supports, 26 and 28, respectively, cross-bars 30, and braces 32 are preferably composed of FRP or any other RF transparent material such that interference with the cell cite is minimized. The FRP medium allows the passage of radio frequency signals, is non-conductive, non-magnetic, and resistant to degradation from environmental effects, each of which is a desirable property for the barrier structure 10.

Four legs 38 are mounted to the underside of base 24 to support antenna barrier 14 above the surface 50. Ballasts 40 (FIG. 1) can be mounted to base 24 to add weight to the base and enhance the barrier's ability to withstand forces of nature such as wind. Preferably, a ballast support surface 39 is defined along a portion of the base 24 to support the ballast 40. As shown in FIGS. 2 and 4, the ballast support surface 39 can be disposed away from the union of the base 24 with the side wall 22 so as to maximize the effect of the ballast 40 in resisting wind forces. The ballast support surface can take on a variety of forms. In the illustrated embodiment it comprises FRP support elements 39 connected between horizontal supports 26. In another arrangement, the horizontal supports 26 are spaced so as to define the ballast support surface free of additional elements. In still another arrangement the ballast support surface can be a generally planar surface such as a shelf supported upon or extending between the horizontal supports 26 and/or the cross-bars 30. Legs 38 and ballasts 40 can be composed of RF transparent materials such that they do not interfere with the RF signals transmitted and received by RF antenna 12. The ballasts 40 preferably permit the antenna barrier to be set in position around the antenna 12 without the need for surface penetrating tools, screws or nails. An epoxy (not shown) can be used to affix legs 38 to surface 50, and as such serves to supplement the legs ability to secure antenna barrier 14 to surface 50.

In the event that the barrier support structure is to be mounted on a peaked roof or hillside, the ballast support surface preferably includes an upstanding flange or wall to engage one or more side surfaces of the ballasts 40. In particular, the weight of the ballast 40 is supported by the ballast support surface 39, while the flange or wall preclude the ballasts 40 from unseating from the support surface 39 due to the inclined surface of the rooftop or hillside.

Each of the antenna barrier sections 16, 18 and 20 includes side walls, bases, horizontal and vertical supports, cross-bars, braces, legs, and where appropriate, hinges, ballasts, screws and bolts to complete a respective section. In a given implementation, any of the sections can include corner panels which include horizontal supports 26 extending in more than one plane, for example, supports 26 that intersect at a common vertical support 28 and an additional vertical support 28 disposed away from the corner.

Referring back to FIG. 1, antenna barriers 14, 16, 18 and 20 can be placed about RF antenna 12 so that the resulting antenna barrier structure 10 entirely surrounds the cell site preventing access thereto. The antenna barrier sections can be tethered or joined together using conventional clips, fasteners or ties; however, it is important that any device used to secure the antenna barrier sections together be made of an RF transparent material so as not to interfere with reception of RF signals at the antenna 12.

Figure 3:
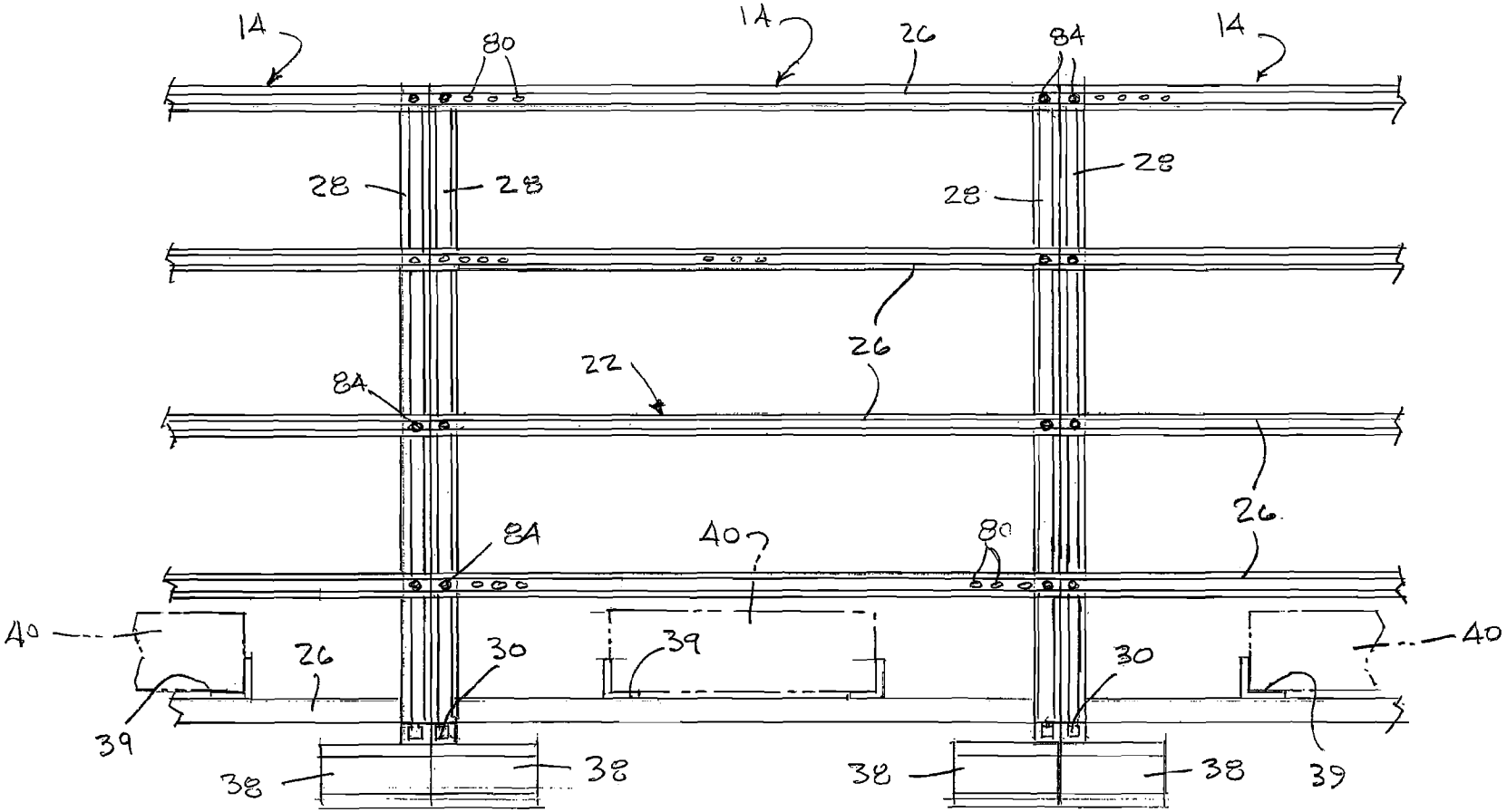
FIG. 3 shows a perspective front view of the antenna barrier structure of FIG. 2.

Referring to FIGS. 2 and 3, horizontal supports 26, vertical supports 28, cross-bars 30 and braces 32 include orifices 80 through which FRP screws 42 can be passed. FRP screws 82 and bolts 84 are preferably used to secure the supports, braces, cross-bars, legs, ballasts and hinges.

FIGS. 4 and 5 show respective front plan and side plan views of the antenna barrier structure of FIG. 1. As compared to the arrangement of FIG. 2, the horizontal supports 26 of the side wall 22 are shown mounted on a rear face of vertical supports 28, and the braces 32 have been omitted. In all other respects this arrangement is the same as previously described.

With further reference to FIG. 5, the ballast support surface 39 is aligned with the vertical supports 28 such that the ballasts 40 optionally can be located at one or more locations along the barrier structure 20 at which the horizontal supports 26 meet the vertical supports 28. Optionally, an RF-transparent sign and RF-transparent sign mounting hardware can be included on antenna barrier 16 to warn or instruct persons approaching the cell site.

Referring now to FIG. 6, a process flow useful for ordering an antenna barrier kit for any given installation it is described. The process flow shown in FIG. 6 can be implemented in a variety of ways, but it is preferred the order be processed through a computer interface, such as a Web-browser based interface to a Web-compliant host machine. At block 110, the user is instructed as to how to define the size of an installation. The size of the installation takes into account physical constraints that may limit the placement of a barrier about an antenna. For example, if an antenna seated on a flat rooftop with space all around, then the size of the installation can be defined as an area surrounding the antenna. On the other hand, for example, if the antenna is mounted is supported by a wall, then the site installation can be defined as a U-shaped region extending away from and back towards the wall so as to surround the antenna on three sides. In like manner, a site installation can be defined on a hillside or other shaped roof surface, and it is preferred that the interface for entering the installation size provide guidance to the user so that sufficient information is obtained to enable a complete set of components to be identified, selected and gathered for inclusion in the antenna barrier kit constructed as a result of a session including the steps of this process flow. At block 120, installation parameters are input by an user. Such parameters include the desired height of the barrier anticipated wind forces, and optional other parameters concerning the dimensions of the barrier kit to be provided. Among the installation parameters that can be input is the size of the installation defined at block 110.

At block 130, calculations are performed to determined the components to be compiled into an antenna barrier kit for this installation site. The calculations take into account the dimensions of any pre-cut horizontal or vertical supports that are to be included in a given kit. For example, the components that are inspected for availability may be limited those that are presently in inventory, as determined with reference by the host machine to an inventory database, can include any known size component regardless of whether it is in inventory. As another example, the parts may include pre-cut pieces of FRP material having specific sizes to be combined so as to satisfy the installation parameters. In response to the calculating step, a pick-list of parts is defined at block 140, with the parts representing all of the components that are necessary for creating the antenna barrier structure, except for the ballast which is supplied by the customer. Optionally, a ballast can be supplied as well. Preferably, the pick-list includes at least one ballast support 39 among the components in the kit, with or without a wall or flange to support the ballast against lateral sliding movement.

The components that are retrieved using the pick-list are then packed and shipped to the purchaser for installation at the site, as indicated at block 150. The pick-list can serve as a parts list of all of the parts being provided to the user. Preferably, assembly instructions are provided with the shipment. Optionally, the assembly instructions can be tailored in response to the calculations performed and the pick-list generated so as to inform the purchaser of how the picked pieces are to be used.

Although the preferred embodiments of the invention have been illustrated and described in detail, it will be readily apparent to those skilled in the art that various modifications may be made therein without departing from the spirit of the invention or from the scope of the appended claims. For example, a wide variety of antenna screen structure, shapes, and sizes may be developed to best fit various cell site locations. In addition, the present invention will accommodate a wide variation in the specific tasks and the specific task ordering used to accomplish the processes described herein.

It is to be understood that this invention is not limited to those precise embodiments and modifications, and that other modifications and variations may be affected by one skilled in the art without departing from the spirit and scope of the invention as defined by the appended claims. Moreover, any one or more features of any embodiment of the invention may be combined with any one or more other features of any other embodiment of the invention, without departing from the scope of the invention.

I claim:

1. A barrier for surrounding a radio frequency (RF) antenna at a location and for placement on a surface at the location, the barrier comprising:

a side wall having horizontal and vertical supports;

a base attached to a bottom edge of the side wall, the base having horizontal supports defining a ballast support surface and cross-bars;

at least one pair of legs depending from the base relative to the surface without penetrating the surface; and wherein the horizontal supports, vertical supports and cross-bars are RF transparent.

2. The barrier as in claim 1 wherein the ballast support surface includes a wall or flange sized to retain a ballast against sliding movement.

3. The barrier as in claim 1 wherein the horizontal supports on the side wall exhibit a U cross section with a hollow interior passage, and have opposing ends connected between two vertical supports.

4. The barrier as in claim 1 wherein the horizontal supports on the base exhibit a U cross section with a hollow interior passage, and have opposing ends connected between two cross-bars.

5. The barrier as in claim 1 wherein the vertical support has a top end and a bottom end and is hingedly connected to the cross-bar at, or proximate, the bottom end.

6. The barrier as in claim 1 wherein the vertical supports span a vertical height of the side wall and are located at opposing ends of the barrier.

7. The barrier as in claim 1 further comprising a support flange coupled between each of the vertical supports and a respective one of the cross-bars, the support flange being RF transparent.

8. The barrier as in claim 1 further comprising a ballast coupled to the ballast support surface of the base making the base heavier than the side wall.

9. The barrier as in claim 1 wherein the side wall and the base further include a first side edge and a second side edge, the first side edge being configured to couple the barrier to a second barrier and the second side edge being configured to couple the barrier to a third barrier, the first side edge comprising one vertical support and crossbar and the second side edge comprising another vertical support and crossbar.

10. The barrier as in claim 1 wherein the vertical and horizontal supports and the cross-bars comprise a plurality of through-holes sized to receive an RF transparent screw.

11. The barrier as in claim 1 wherein the side wall and base are formed from fiber reinforced plastic.

* * * * *